US007066550B1

(12) United States Patent
Su

(10) Patent No.: US 7,066,550 B1
(45) Date of Patent: Jun. 27, 2006

(54) SEAT ASSEMBLY FOR CHAIR

(76) Inventor: Tung-Hua Su, No. 6, Sec. 3, Bao Ta Rd, Kuwi Jen Hsiang, Tainan Hsien (TW)

( * ) Notice: Subject to any disclaimer, the term of this patent is extended or adjusted under 35 U.S.C. 154(b) by 0 days.

(21) Appl. No.: 11/125,483

(22) Filed: May 10, 2005

(51) Int. Cl.
*A47C 7/00* (2006.01)

(52) U.S. Cl. ..... 297/440.22; 297/452.59; 297/452.64; 297/452.56

(58) Field of Classification Search ..... 297/440.2, 297/440.22, 452.55, 452.59, 452.64, 452.56
See application file for complete search history.

(56) References Cited

U.S. PATENT DOCUMENTS 6,059,368 A * 5/2000 Stumpf et al. ..... 297/440.11
6,565,157 B1 * 5/2003 Barile et al. ..... 297/452.52
6,935,698 B1 * 8/2005 Chen ..... 297/440.22

FOREIGN PATENT DOCUMENTS

EP 210710 A2 * 2/1987
GB 2136284 A * 9/1984

* cited by examiner

*Primary Examiner*—Anthony D. Barfield
(74) *Attorney, Agent, or Firm*—Charles E. Baxley

(57) ABSTRACT

A seat for a chair includes a loop-like main frame having an upper flange wall and a lower flange wall. The main frame further includes an inner engaging edge extending radially inward and an outer flange extending radially outward. An upper perimeter face of the outer flange and an outer perimeter of the upper flange wall together define an upper coupling section to which a coupling frame is securely mounted. A rigid bottom board is securely mounted to the inner engaging edge. A mesh is mounted on top of the upper flange wall and fixed to the main frame. The mesh includes a perimeter covering the upper coupling section, with a space being delimited between the mesh and the bottom board. The seat has a reliable structure and provides cool, comfort sitting by provision of the space between the mesh and the bottom board.

6 Claims, 6 Drawing Sheets

SEAT ASSEMBLY FOR CHAIR

BACKGROUND OF THE INVENTION

1. Field of the Invention

The present invention relates to a seat assembly. In particular, the present invention relates to a seat assembly for a chair.

2. Description of the Related Art

A conventional chair typically comprises a rigid bottom board, a foam mounted on top of the bottom board, and a thin covering layer of cloth, leather, etc covering the foam, with a perimeter edge of the covering layer fixed to the bottom board. However, the foam between the covering layer and the bottom board results in poor air-permeability and the user will feel uncomfortable due to the heat in the buttocks.

SUMMARY OF THE INVENTION

A seat for a chair in accordance with the present invention comprises a main frame, a rigid bottom board, a mesh, and a coupling frame. The main frame is a loop member and comprises an upper flange wall and a lower flange wall respectively extending from an upper side thereof and a lower side thereof. The main frame further comprises an inner engaging edge extending radially inward and an outer flange extending radially outward. The outer flange includes an upper perimeter face, and the upper flange wall includes an outer perimeter, with the upper perimeter face of the outer flange and the outer perimeter of the upper flange wall together defining an upper coupling section to which the coupling frame is securely mounted.

The rigid bottom board is securely mounted to the inner engaging edge. The mesh is mounted on top of the upper flange wall and fixed to the main frame. The mesh comprises a perimeter covering the outer perimeter of the upper flange wall and the upper perimeter face of the outer flange, with a space being delimited between the mesh and the bottom board.

The seat has a reliable structure and provides cool, comfort sitting by provision of the space between the mesh and the bottom board.

Preferably, the inner engaging edge and the lower flange wall together define a receiving section for accommodating the bottom board.

Preferably, the coupling frame further comprises a downwardly extending pressing portion on an inner perimeter edge thereof, and the pressing portion presses against the mesh.

Preferably, the bottom board further comprises a plurality of fixing holes for coupling with a chassis and armrests of a chair.

Preferably, each of the bottom board and the inner engaging edge comprises a plurality of holes. The seat further comprises a plurality of fasteners each extending through an associated hole of the bottom board and an associated hole of the inner engaging edge.

Preferably, each of the outer flange and the pressing portion of the coupling frame comprises a plurality of holes. The seat further comprises a plurality of fasteners each extending through an associated hole of the outer flange and the mesh into an associated hole of the pressing portion of the coupling frame.

Other objectives, advantages, and novel features of the invention will become more apparent from the following detailed description when taken in conjunction with the accompanying drawings.

DETAILED DESCRIPTION OF THE PREFERRED EMBODIMENT

Figure 6A:
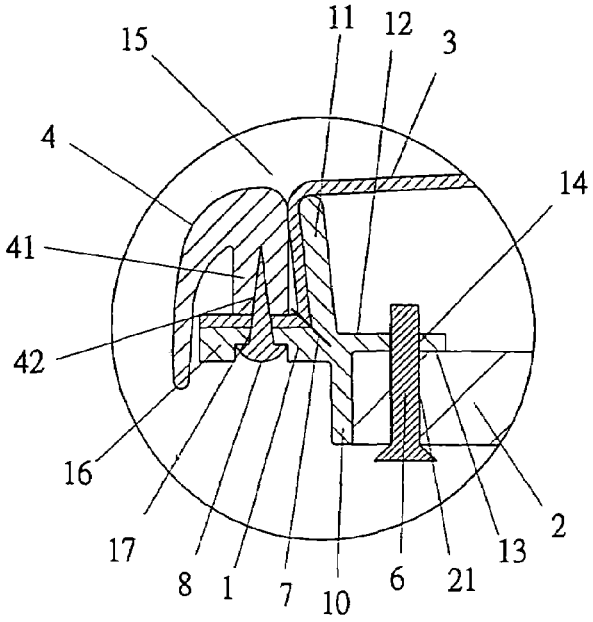
FIG. 6A is an enlarged view of a circled portion in FIG. 6.

Referring to FIGS. 1 through 6, a seat in accordance with the present invention comprises a main frame 1, a bottom board 2, a mesh 3, and a coupling frame 4. The main frame 1 is a substantially loop member with a sufficient strength. In particular, as illustrated in FIG. 6A, the main frame 1 comprises an upper flange wall 11 and a lower flange wall 10 respectively extending from an upper side and an underside of the main frame 1. Each flange wall 11, 10 has an appropriate height. The main frame 1 further comprise an inner engaging edge 12 extending radially inward from the main frame 1 and an outer flange 16 extending radially outward from the main frame 1.

The inner engaging edge 12 and the lower flange wall 10 together define a space or receiving section 13 for accommodating the bottom board 2. The bottom board 2 is a rigid board made of wood, plastic, etc. In the illustrated embodiment, a plurality of fasteners 6 are provided, with each fastener 6 extending through an associated hole 21 in the bottom board 2 and an associated hole 14 in the inner engaging edge 12, best shown in FIG. 6A. The bottom board 2 further includes a plurality of fixing holes 22 and 23 (FIGS. 1 through 3) for engaging with a chassis (not shown) and armrests (not shown) of a chair.

Figure 1:
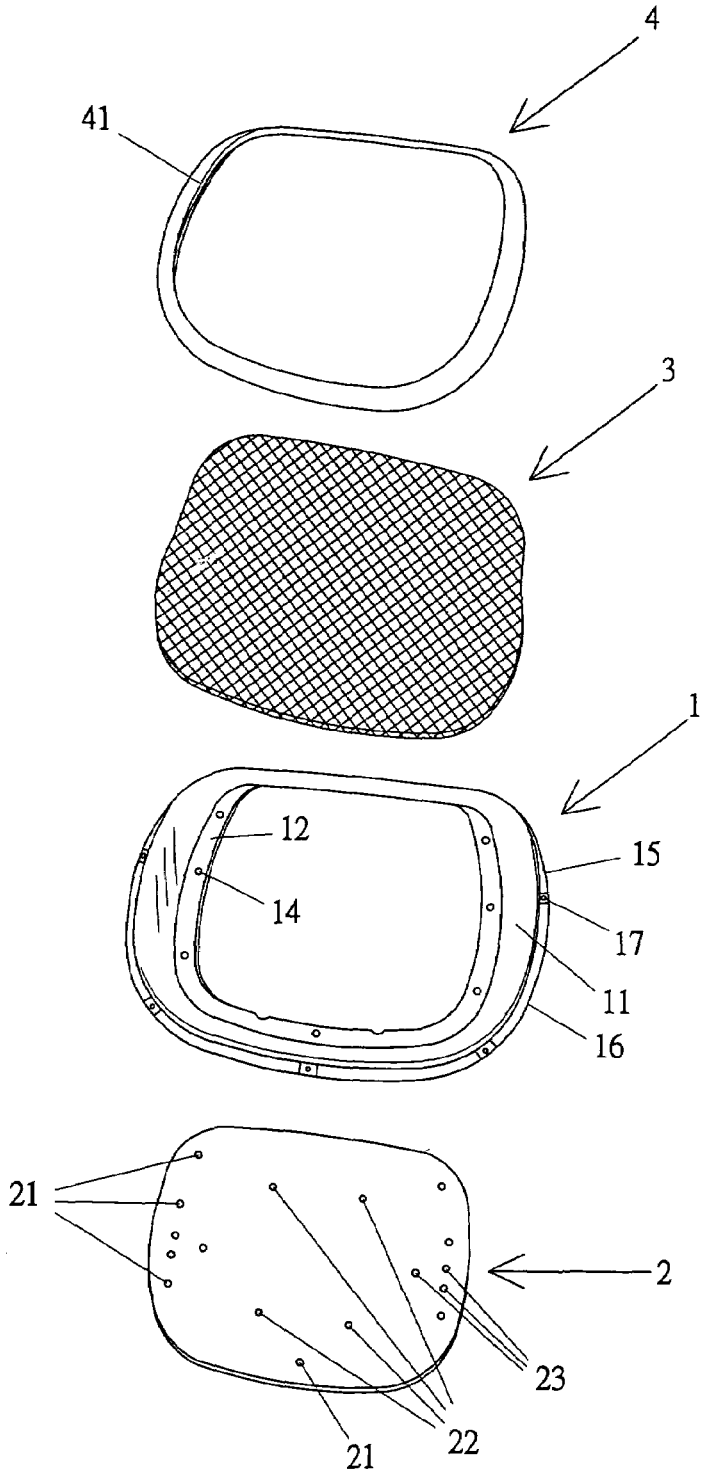
FIG. 1 is a front exploded perspective view of a seat for a chair in accordance with the present invention.
Figure 2:
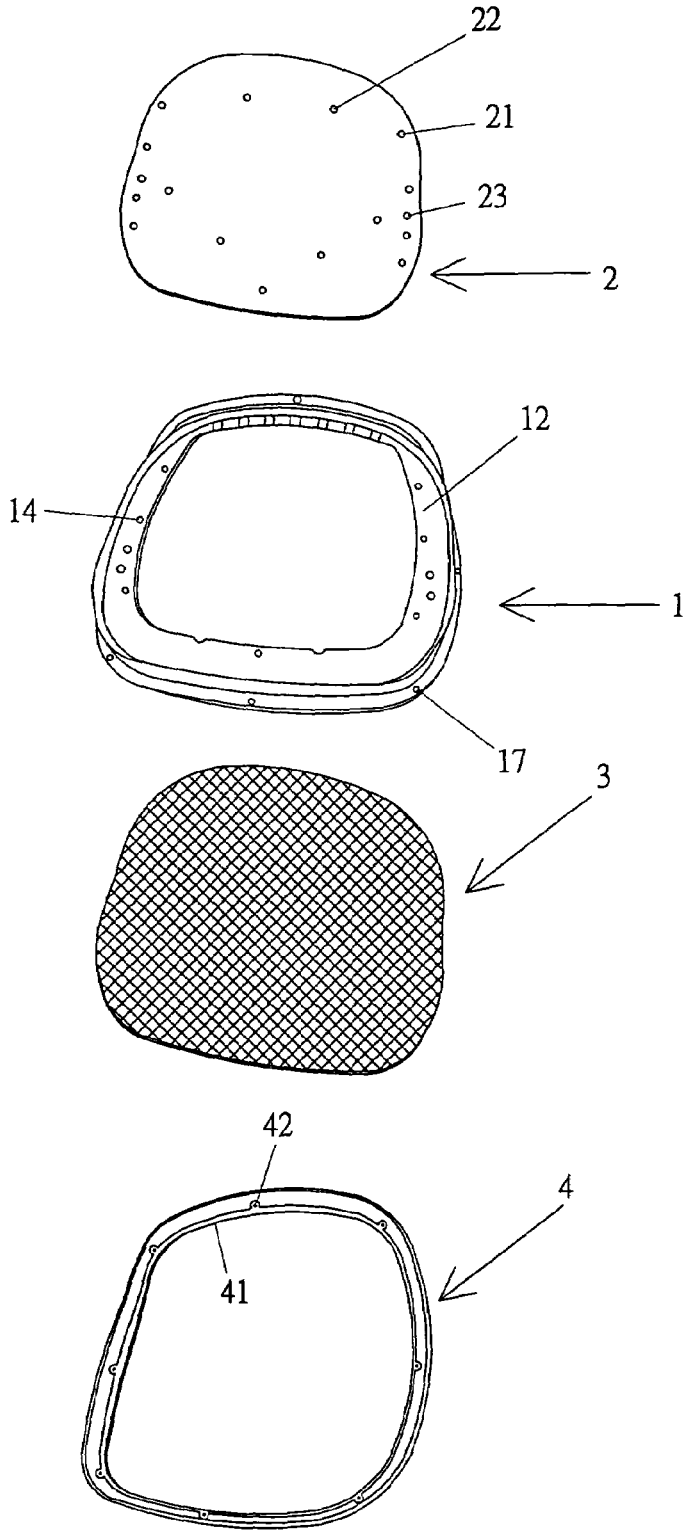
FIG. 2 is a rear exploded perspective view of the seat in accordance with the present invention.
Figure 3:
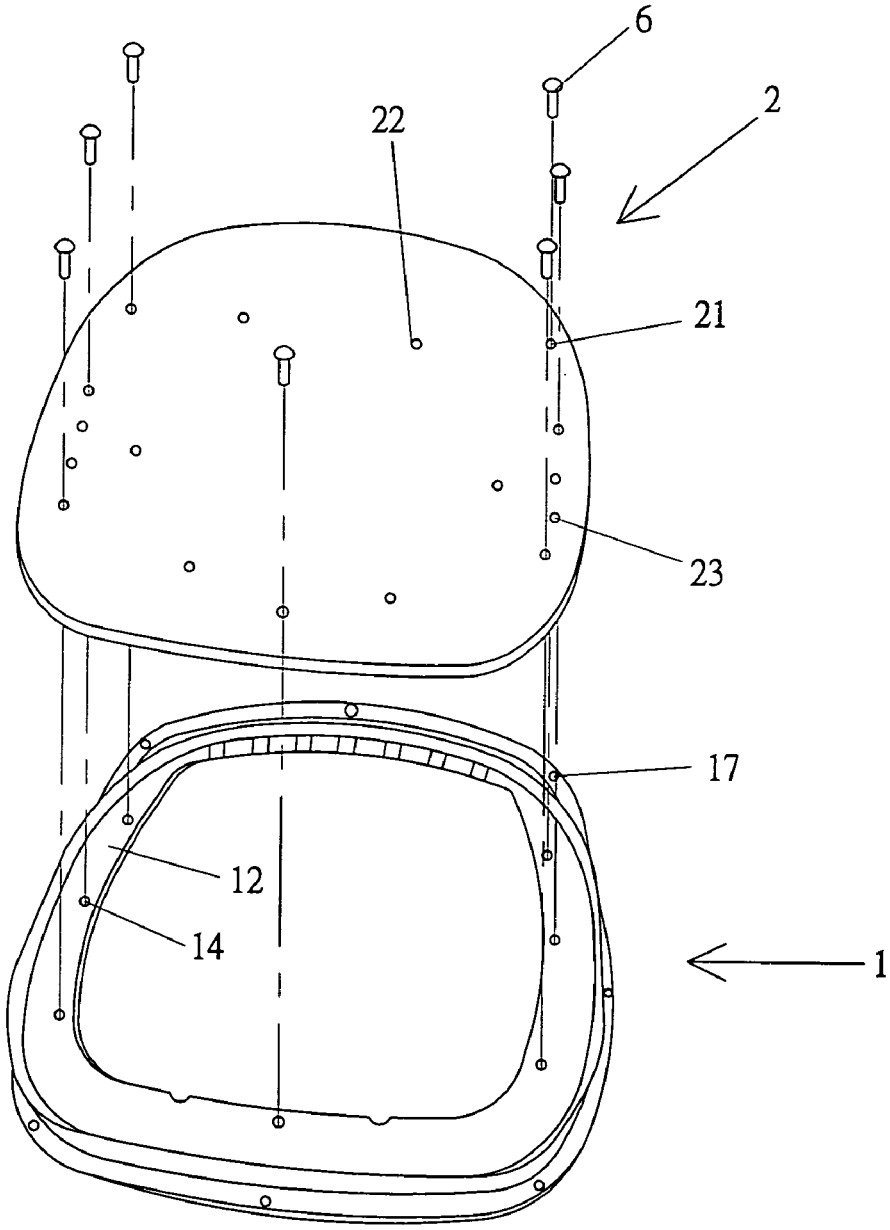
FIG. 3 is an exploded perspective illustrating engagement of a bottom plate and a main frame of the seat in accordance with the present invention.
Figure 4:
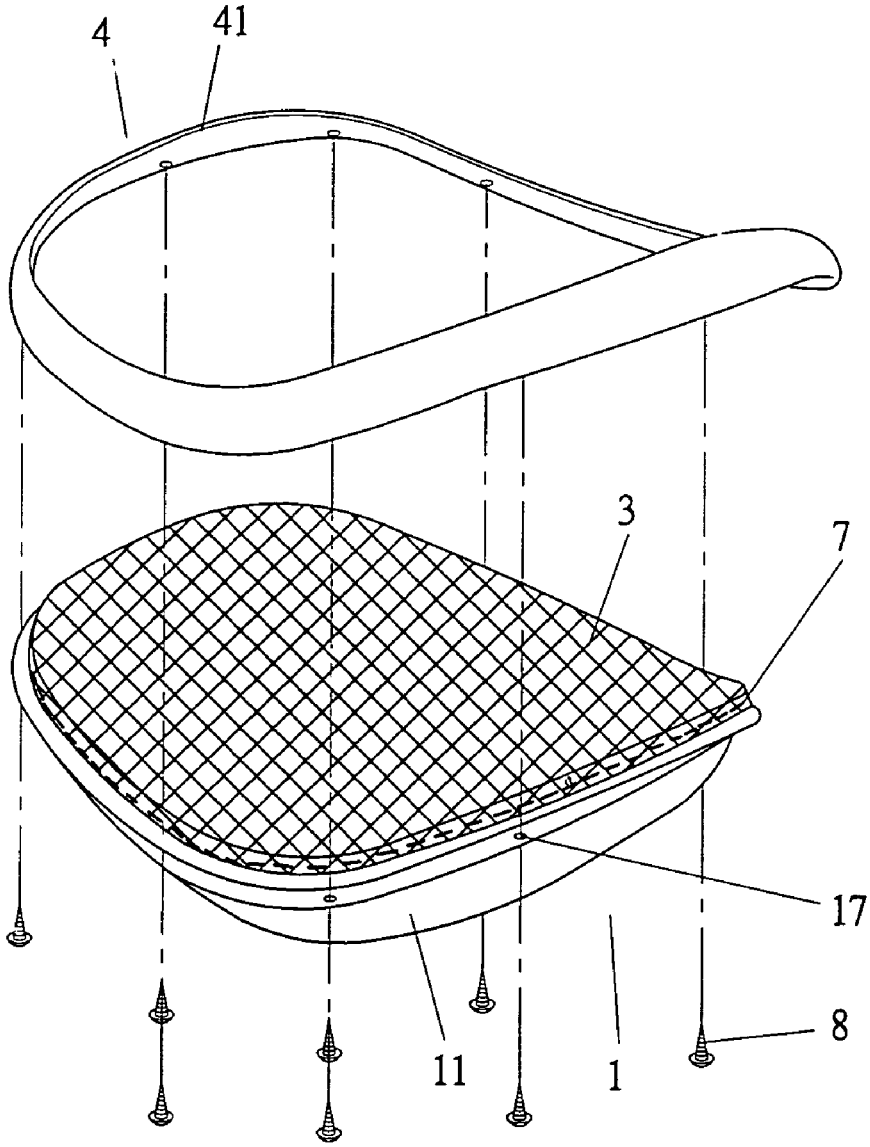
FIG. 4 is an exploded perspective view illustrating engagement of a mesh, the main frame, and a coupling frame of the seat in accordance with the present invention.
Figure 5:
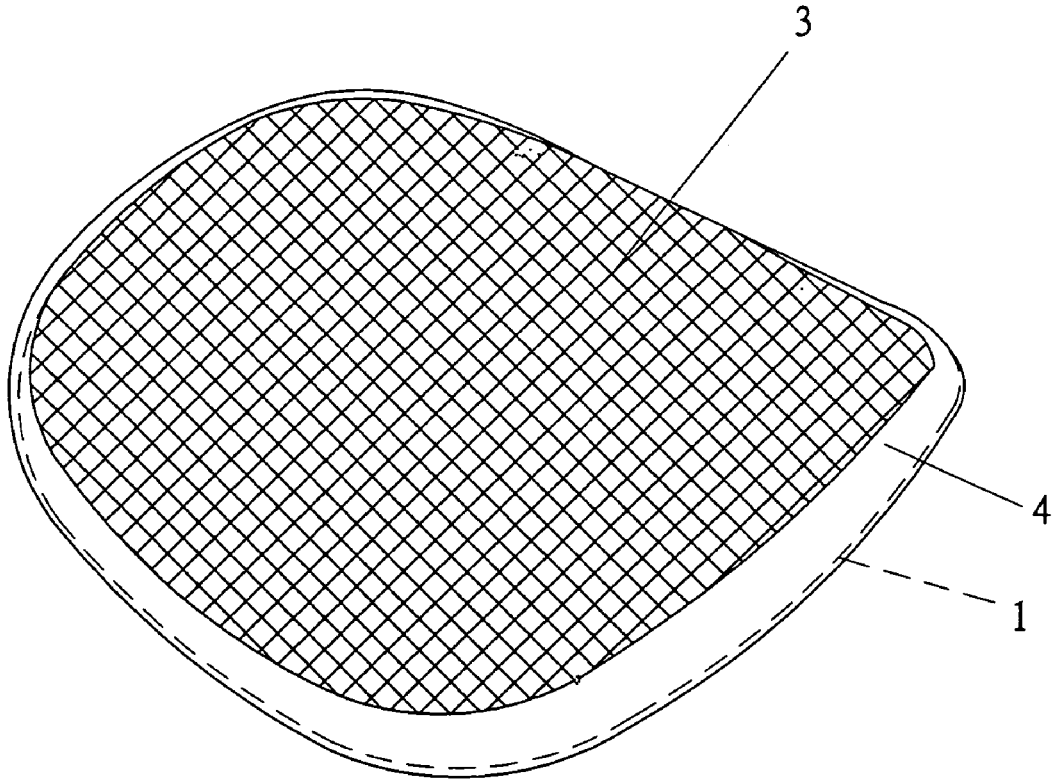
FIG. 5 is a perspective view of the seat in accordance with the present invention.
Figure 6:
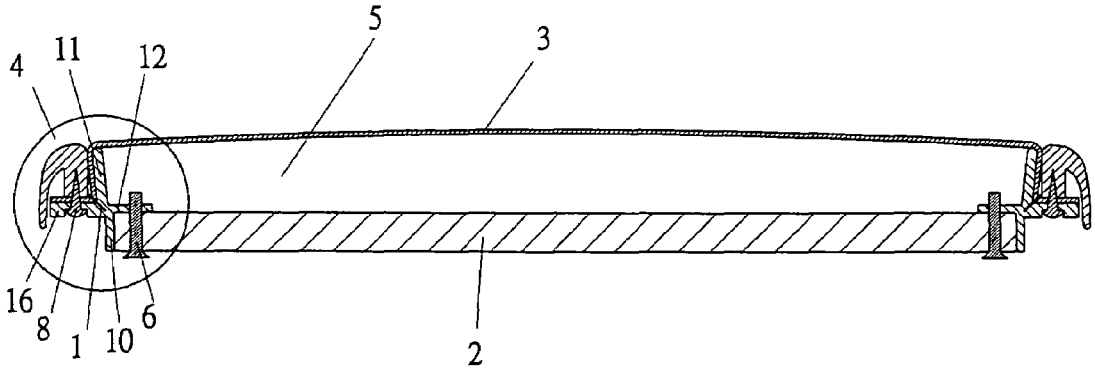
FIG. 6 is a sectional view of the seat in accordance with the present invention.

As illustrated in FIGS. 4, 6, and 6A, the mesh 3 is mounted on top of the upper flange wall 11, with a perimeter of the mesh 3 covering an outer perimeter of the upper flange wall 11 and an upper perimeter face of the outer flange 16. The mesh 3 is fixed to the main frame 1 by extending fasteners 7 (such as nails, staplers, etc), with a space 5 being delimited between the mesh 3 and the bottom board 2.

The coupling frame 4 is mounted to an upper coupling section 15 delimited by the outer perimeter of the upper flange wall 11 and the upper perimeter face of the outer flange 16, with an outer perimeter edge of the coupling frame 4 enclosing the upper coupling section 15. The coupling frame 4 further includes a downwardly extending pressing portion 41 on an inner perimeter edge thereof. A plurality of fasteners 8 are provided to fix the coupling frame 4 in place. As illustrated in FIG. 6A, each fastener 8 is extended through an associated hole 17 in the outer flange 16 and the mesh 3 into an associated hole 42 in the coupling frame 4. The mesh 3 is thus pressed against and retained in place by the pressing portion 41.

The seat in accordance with the present invention has a reliable structure and provides cool, comfort sitting by provision of the space 5. Further, the user is well supported, as the inner engaging edge 12 is supported by the bottom board 2.

The bottom board 2 can be produced in mass production. The bottom board 2 may have different shapes. Nevertheless, the bottom board 2 can be coupled to chassis or armrests of various types due to the separate design of the main frame 1 and the bottom board 2. Only a change in the position of the fixing holes 22 and 23 is required.

Although a specific embodiment has been illustrated and described, numerous modifications and variations are still possible without departing from the essence of the invention. The scope of the invention is limited by the accompanying claims.

What is claimed is:

1. A seat for a chair, the seat comprising:

a main frame, the main frame being a loop member, the main frame comprising an upper flange wall and a lower flange wall respectively extending from an upper side thereof and a lower side thereof, the main frame further comprising an inner engaging edge extending radially inward and an outer flange extending radially outward, the outer flange including an upper perimeter face, the upper flange wall including an outer perimeter, the upper perimeter face of the outer flange and the outer perimeter of the upper flange wall together defining an upper coupling section;

a rigid bottom board securely mounted to the inner engaging edge;

a mesh mounted on top of the upper flange wall and fixed to the main frame, the mesh comprising a perimeter covering the outer perimeter of the upper flange wall and the upper perimeter face of the outer flange, with a space being delimited between the mesh and the bottom board; and a coupling frame securely mounted to the upper coupling section.

2. The seat for a chair as claimed in claim 1, with the inner engaging edge and the lower flange wall together defining a receiving section for accommodating the bottom board.

3. The seat for a chair as claimed in claim 1, with the coupling frame further comprising a downwardly extending pressing portion on an inner perimeter edge thereof, with the pressing portion pressing against the mesh.

4. The seat for a chair as claimed in claim 3, with the outer flange comprising a plurality of holes, with the pressing portion of the coupling frame comprising a plurality of holes, with the seat further comprising a plurality of fasteners, with each said fastener extending through an associated one of the holes of the outer flange and the mesh into an associated one of the holes of the pressing portion of the coupling frame.

5. The seat for a chair as claimed in claim 1, with the bottom board further comprising a plurality of fixing holes for coupling with a chassis and armrests of a chair.

6. The seat for a chair as claimed in claim 1, with the bottom board comprising a plurality of holes, with the inner engaging edge comprising a plurality of holes, with the seat further comprising a plurality of fasteners, with each said fastener extending through an associated one of the holes of the bottom board and an associated one of the holes of the inner engaging edge.

* * * * *